United States Patent [19]

Sato

[11] 4,208,964

[45] Jun. 24, 1980

[54] CONSTANT PRESSURE PRINTING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 897,408

[22] Filed: Apr. 18, 1978

[30] Foreign Application Priority Data

Apr. 20, 1977 [JP] Japan ..... 52/044556
May 16, 1977 [JP] Japan ..... 52/055286

[51] Int. Cl.[2] ..... B41J 5/00

[52] U.S. Cl. ..... 101/291; 156/384; 101/288; 101/93.03; 101/298; 101/316; 400/157.3; 400/166; 400/437

[58] Field of Search ..... 156/384; 101/287, 288, 101/291, 292, 316, 297, 298, 10, 20, 93.02, 93.03; 400/157.3, 166, 167, 388, 388.1, 389, 397, 424, 428, 435, 437, 440.2, 648, 649, 686, 687; 267/158; 227/132; 74/97, 2; 173/118, 120, 139; 251/75, 251, 263, 262, 76–78, 80

[56] References Cited

U.S. PATENT DOCUMENTS

| | | | |
|---|---|---|---|
| 1,064,674 | 6/1913 | Ursbruck | 400/460.2 |
| 1,765,326 | 6/1930 | Desha | 400/397 |
| 3,042,357 | 7/1962 | Engholdt | 251/78 |
| 4,072,105 | 2/1978 | Becker et al. | 101/288 |

*Primary Examiner*—William Pieprz
*Attorney, Agent, or Firm*—Ostrolenk, Faber, Gerb & Soffen

[57] ABSTRACT

A contant pressure printing mechanism for use with a hand labeler which prints a label: an actuating lever, which is pivotally connected to the frame of the hand labeler, is divided into a hand lever and a printing lever, and both of these levers are also pivotally connected. A printing head is carried by the printing lever. The hand lever and the printing lever are biased to move together as a unit. The operating lever engages a snap mechanism which applies a preset resistance to rotation of the operating lever as the printing lever is turned toward the printing platen. In one embodiment, the snap mechanism includes a pressure roller and a snap bail. The pressure roller is rotatably mounted to either the hand lever or the frame of the hand labeler while the snap bail is mounted pivotally to the other. As the squeezing of the hand lever increases, the operating lever snaps past the snap mechanism and the snap movement urges the printing lever toward the platen. In another embodiment, the pressure roller is rotatably mounted to the printing lever while a snap member is pivotally mounted to the hand lever. In this embodiment, the pressure roller and the snap member hold the levers together and the pressure roller snaps past the snap member only after the printing head contacts the platen. In all cases, the printing head can be moved into abutment against the printing platen under a constant printing pressure and for a preset period. The printing head can also be returned from the platen by the action of the return spring immediately after it has abutted against the platen.

40 Claims, 7 Drawing Figures

CONSTANT PRESSURE PRINTING MECHANISM FOR HAND LABELER

BACKGROUND OF THE INVENTION

1. Field of the Invention

The present invention relates to a label printing and applying device, preferably of the portable type (which will hereinafter be referred to as a "hand labeler"), and more particularly to a constant pressure printing mechanism for use with the hand labeler. The device makes the printing pressure constant to accomplish the clear printing of labels without any difference in the shading.

2. Description of the Prior Art

Most conventional hand labelers have an integral actuating lever which is comprised of an integrally connected hand lever and printing lever. The actuating lever is pivotally supported on a pivot pin which is positioned between the hand lever and the printing lever. A printing head is mounted to the leading or forward end of the printing lever so that the printing head may be moved toward a printing platen by squeezing of the hand lever. The printing head imprints a label which has been fed onto the surface of the platen.

Because the squeezing force applied to the hand lever of the conventional hand labeler is converted directly into printing pressure against the platen, variations in the squeezing force are liable to produce differently shaded imprints. Moreover, if the hand lever is squeezed especially strongly and swiftly, its impact against the platen causes the printing head to bounce slightly against the platen, which causes double printing on the labels and a resultant deterioration in the printing quality of the labels.

If the conventional hand lever is squeezed for a long time, the types of the printing head are held in contact with the label surface for such a long time that the imprints become too thick. If, on the other hand, the hand lever is released too quickly, the types leave the label surface so quickly that the imprints become too light. Thus, differently shaded imprints are caused by variations in the length of the squeezing time.

Even unclear labels obtained by printing operations by hand labelers of the above type are considered to barely succeed in performing their functions if the imprints can only barely be read out both by customers when they purchase commodities and by clerks when they calculate the sales. In recent years, however, clerks taking care of registers have been replaced by optical character reader mechanisms. A reader is connected with an electronic computer system. This enables use of the POS (i.e., Point-of-Sale) system, in which the numerals or characters (e.g., bar codes or OCR symbols) on the labels are automatically read out to record and process in the computer system relevant business information, such as the stock, sales, sales analysis for each commodity or profit calculation. In a machine controlled POS system, it is required that the imprints on the labels be clear at all times.

SUMMARY OF THE INVENTION

It is, therefore, an object of the present invention to provide a constant pressure printing mechanism for use with a hand labeler, or the like, which can be free from any drawbacks concomitant with conventional printing devices.

It is another object of the present invention to provide a constant pressure printing mechanism of the above type, in which the printing pressure upon a label surface is made constant.

It is a further object of the invention to provide such a mechanism wherein the duration of an imprinting is made constant during each printing stroke.

It is a further object of the invention to accomplish clear printing of the labels at all times without any differences in their shadings.

It is yet another object of the invention to reduce the impact of the printing types on the platen during the imprinting operation, to prevent double printing.

It is another object of the invention to quickly raise the printing types from the label surface immediately after the printing operation.

It is yet another object of the invention to imprint labels by overcoming a preset resistance to printing motion of the printing head.

The present invention concerns constant pressure printing mechanisms for use with a hand labeler, or the like, and which are operative to print labels and to apply the printed labels to commodities. A printing mechanism according to the invention is comprised of the following elements. A printing platen is mounted on the frame of the hand labeler. An actuating lever is mounted on the frame of the hand labeler for pivoting movement between a released position and a squeezed position. The actuating lever is divided into a hand or operating lever and a printing lever. These levers are pivotally connected. A return spring biases the actuating lever toward its released position. A printing head is carried by the printing lever. The printing head is located at an inoperative position, apart from said printing platen, when the actuating lever is at the released position and is located at a printing position against the printing platen when the actuating lever is at the squeezed position. A second return spring is provided for biasing the printing and the hand levers to rotate toward each other in a direction that moves the two levers to shift together as one actuating lever. Cooperating abutting means join the two levers. In one embodiment, the cooperating abutting means are abutment surfaces on the print and hand levers. In another embodiment, the elements of the below described snap means, one on the print lever and one on the hand lever, provide the abutting connection between the levers. In one embodiment, the second return spring is interposed between the hand lever and the printing lever for biasing the two levers to rotate toward each other into a fixed relative position which is determined by the cooperating abutting means. In another embodiment, the second return spring is interposed between the printing lever and the frame for biasing the printing lever to rotate toward the hand lever.

Snap means offer a preset resistance to motion of the actuating lever, when the printing lever is turned toward the printing platen until the preset resistance is exceeded and the actuating lever snaps past the snap means. The printing head is brought into abutment against the printing platen and against the biasing force of the second named return spring, at a pressure determined by the squeezing pressure on the hand lever required to overcome the resistance of the snap means. In one embodiment, the actuating lever snaps past the snap means before the printing head contacts the platen and this snap, through the cooperating abutting means, imparts inertial motion to the print lever so that the printing head will strike the platen. In another embodiment, the printing head contacts the platen before the actuating lever snaps past the snap means and at the point of the snap, the maximum printing pressure is determined and the printing head thereafter is raised off the platen. In all embodiments, the printing head is returned from the printing position together with the printing lever by the biasing force of the second-named return spring immediately after the printing head has abutted against the platen.

Although the constant pressure printing mechanism according to the present invention is described herein as being used for a hand labeler, it is also useful for other printing devices, such as a tagging device or a desk type label printer.

Other objects and features of the invention will be apparent from the following description and accompanying drawings.

DESCRIPTION OF THE PREFERRED EMBODIMENTS

Figure 1:
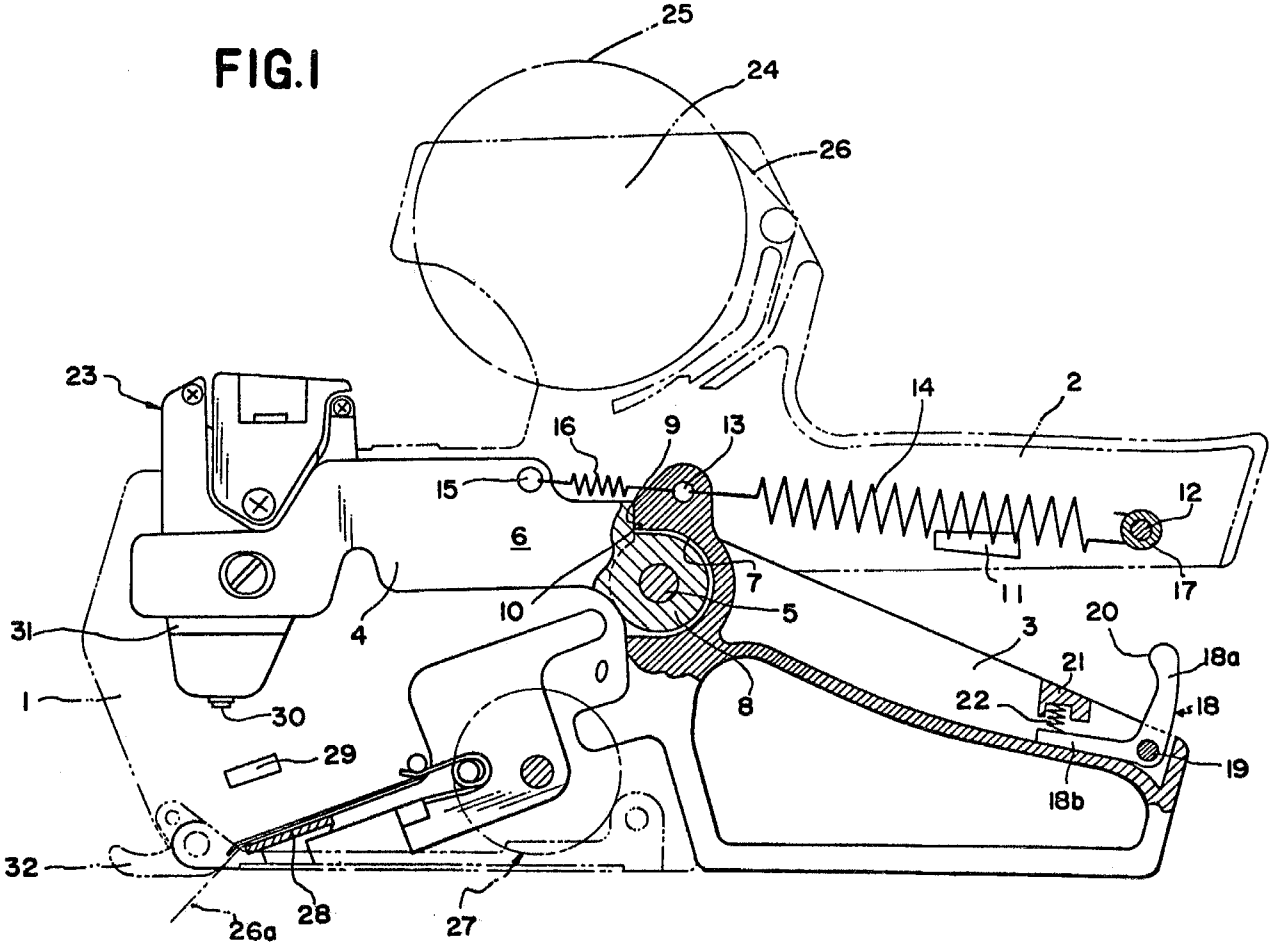
FIG. 1 is a side elevational view showing a hand labeler, which is equipped with a first embodiment of a constant pressure printing mechanism according to the present invention, with the side frame on the viewing side removed for illustration.
Figure 2:
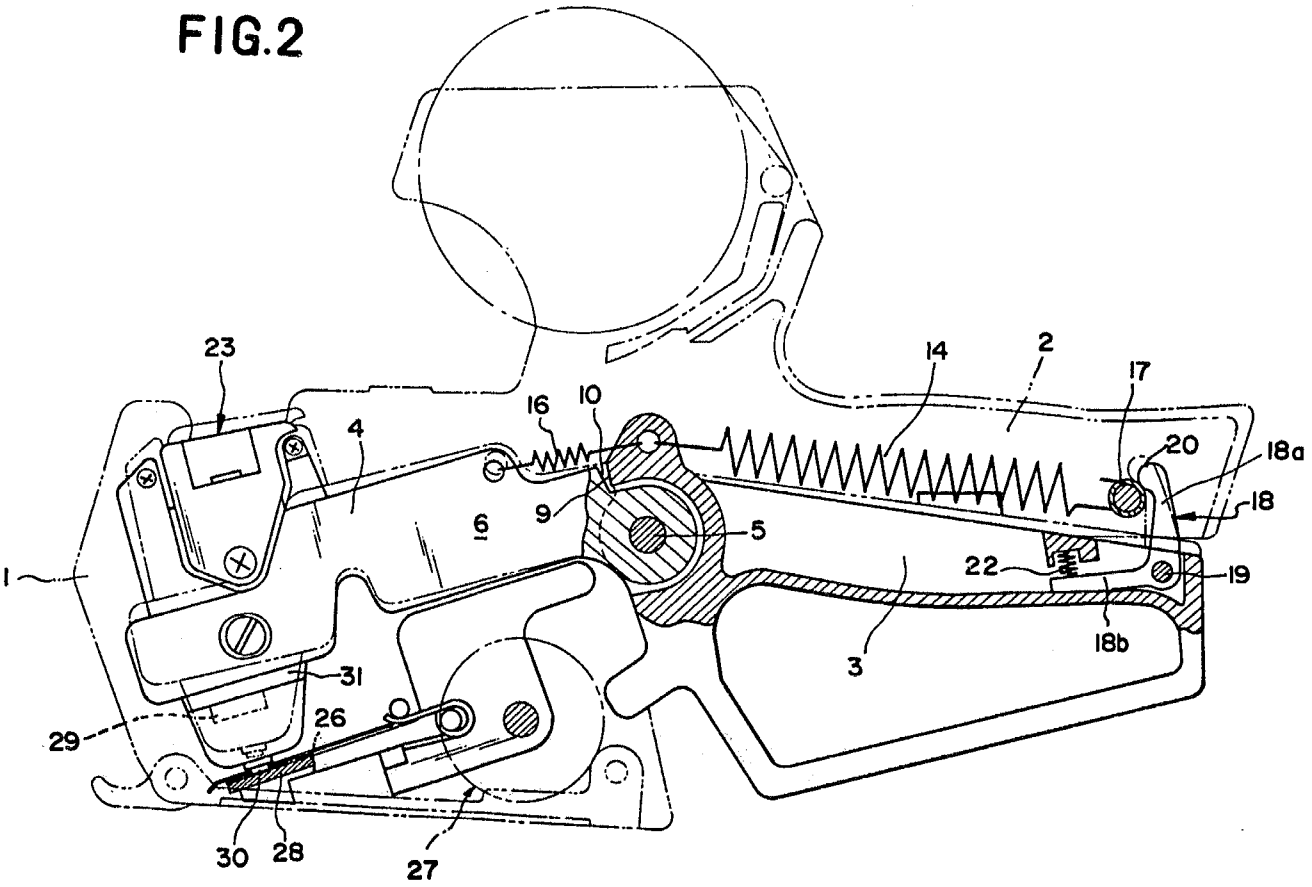
FIG. 2 shows the hand labeler of FIG. 1 in the printing condition, with the hand lever squeezed through its full stroke.

In FIGS. 1 and 2, which show the first embodiment of the present invention, a hand labeler is shown having side frames 1 that are formed integrally at their rear (or right-hand in FIG. 1) portions into a grip 2. The remaining below described components are arranged between the side frames 1. There is an operating or hand lever 3. A printing lever 4 is separate from the lever 3 and is bifurcated in shape. The two separate levers 3 and 4 are both pivotally mounted on a pivot pin 5. The pin 5 is mounted stationary to the side frames 1. Together, the levers 3, 4, 5 constitute an actuating lever 6. At the pivotal connection, the rear end of the printing lever 4 includes an annular portion 8 which is fitted into a cooperatingly shaped arcuate portion 7 formed at the front end of the actuating lever 3. The pivot pin 5 extends through the two portions 7 and 8. Under the released condition of FIG. 1, the abutment surface 9 formed at the upper front end of the operating or hand lever 3 is in abutment engagement with the abutment surface 10 that is formed at the upper rear end of the annular portion 8 of the printing lever 4. The surfaces 9, 10 are cooperating abutting surfaces that connect the levers 3 and 4 to move together as one actuating lever 6 toward the squeezed position of that lever. The abutment between surfaces 9 and 10 prevents the lever 4 from rotating in the upward (or clockwise) direction with respect to the lever 3. It also causes the lever 4 to rotate counterclockwise with the lever 3 as the lever 3 is squeezed, whereby during squeezing of the actuating lever 6 through the below described snap, the entire actuating lever moves as a unit.

There is fixedly mounted in the grip 2 a stopper 11 for blocking squeezing rotation of the lever 3 beyond the below described snap and prior to a position of the hand lever that would cause the hand lever, through surfaces 9 and 10, to force the printing head types 30 (described below) into engagement with the platen 28.

There is a spring pin 12 in the grip 2. A return spring 14 is mounted under tension between the spring pin 12 and a spring hole 13 which is formed in the upper front end of the hand lever 3. This normally urges the hand lever 3 to return clockwise.

A second return spring 16 is mounted under tension between the spring hole 13 and another spring hole 15 formed in the printing lever 4. This normally urges the lever 4 clockwise and keeps the surfaces 9, 10 in abutment, whereby the entire actuating lever 6 is movable as a unit counterclockwise. The two return springs 14 and 16, therefore, bias both the hand lever 3 and the printing lever 4 clockwise about the pivot pin 5 at all times.

The snap means has the following features. A pressure receiving roller 17 is mounted on the spring pin 12. An L-shaped snap bail 18, made of an elastic material, such as an elastic plastic, is pivotally mounted by the pin 19 to the rear end portion of the hand lever 3. The snap bail 18 is L-shaped and is comprised of an upstanding, resilient snap arm 18*a* and a spring-biased arm 18*b* which extends substantially at a right angle to the snap arm 18*a*. The snap arm 18*a* includes a snap surface 20 at its end, which projects forwardly of the labeler. The lower surface of the spring-biased arm 18*b* abuts against the bottom of the upper arm of the hand lever 3 for precluding counterclockwise pivoting of bail 18. There is a compression spring 22 between the upper surface of the spring-biased arm 18*b* and a spring receiving member 21 which is fixed to the side wall of the hand lever 3. The snap bail 18 thus is rotatable only clockwise about the pin 19, against the force of the compression spring 22.

A printing head 23 is mounted to the leading or front end of the printing lever 4. The lower end of the printing head 23 has printing types 30 projecting beneath it.

A holder 24 for a rolled label strip 25 has the label strip 25 unrolled from the holder at 26 and the labels are fed onto a printing platen 28 by means of a known feed mechanism 27.

Stoppers 29 are formed on the inside walls of the side frames 1. The flanges 31 formed on the side of the printing head 23 are moved with the printing head into abutment with the stoppers 29 when the printing head 23 is moved down so that the printing head 23 will have its descent stopped at a preset suitable position just as the types 30 abut the platen.

It should be understood that the dividing position of the actuating lever 3, 4 and the attaching positions of the pressure member and of the snap bail should not be restricted to those disclosed in the foregoing or other embodiments. These can be determined suitably, according to the present invention, if similar results can be obtained.

Operation of the first embodiment of the invention is now described. FIG. 1 shows the hand labeler in its stationary or released condition. The operating or hand lever 3 is manually squeezed toward the grip 2, and this rotates the lever 3 upward or counterclockwise. Then, the abutment surface 9 of the hand lever 3 pushes against the abutment surface 10 of the printing lever 4 so that the printing lever 4 is also turned counterclockwise about the pivot pin 5 to move down together with the printing head 23. Meanwhile, an inking roller (not shown) rolls over the surface of the printing types 30 and supplies them with ink.

If the hand lever 3 is squeezed further, the top of the snap surface 20 of the snap bail 18 on the hand lever 3 moves into abutment engagement with the outer periphery of the pressure roller 17 on the grip 2. The spring 22 and the elasticity of the bail 18 urge the bail arm 18*a* counterclockwise against the roller 17 so that the squeezing force on the hand lever is resisted.

As additional squeezing force is applied to overcome the resistance to motion of the bail 18, the snap bail 18 is moved upwardly, while being slightly warped rearwardly (or to the right) due to its flexibility and while the bail 18 is pivoted against spring 22, and the snap surface eventually rides over the pressure roller 17, as shown in FIG. 2. Thereafter, the snap arm 18*a* restores itself to its initial condition of FIG. 1.

When the snap surface 20 overcomes the resistance of and rides over the pressure roller 17, the abutment surface 9 of the hand lever 3 strongly and suddenly pushes the abutment surface 10 of the printing lever 4 counterclockwise. The impact jolts the lever 4 to move toward the platen and the now moving printing lever develops inertia. Consequently, the printing lever 4 rotates counterclockwise or downward about the pivot pin 5, and against the force of the return spring 16. Its inertia carries the lever 4 away from the lever 3 so that the surfaces 9 and 10 separate. The inertia further carries the printing types 30 of the printing head 23 to abut against the unrolled label strip 26 on the platen 28 and imprints the types on the label strip.

After the imprinting, the printing lever 4 is instantly turned clockwise (or upward) by the force of the return spring 16. The printing types 30 raise off the label surface, as shown in double-dotted lines in FIG. 2. Further, the abutment surface 10 of the printing lever 4 again abuts against and is stopped by the abutment surface 9 of the hand lever 3.

When the hand lever 3 is subsequently released, the hand lever 3 and the printing lever 4 are turned clockwise about the pivot pin 5 by the tensile actions of the return springs 14 and 16. Now, the lower side of the snap surface 20 of the snap bail 18 is brought into abutment engagement with the pressure roller 17 and the return of the hand lever 3 is subjected to resistance. However, the releasing operation is different from the sqeeezing operation in that the resistance that is applied to the snap surface 20 is not very high. This is in part because the snap bail 18 receives a force in the clockwise direction from the pressure roller 17 so that the bail can rotate in the clockwise direction about the pivot pin 19 against the action of the compression spring 22. Further, the profiling of the underside of the snap surface 20 facilitates the easy return passage of snap bail 18. Therefore, the snap surface can ride over the pressure roller 17 relatively easily and the hand lever 3 and the printing lever 4 return to their initial conditions shown in FIG. 1.

Also during this return motion, the unrolled label strip 26 is advanced the length of one label by the action of the feed mechanism 27 so that the labels to be printed are delivered to the platen, one by one, and the printed labels 26*a* are fed, one by one, below a label applying member 32, which applies each label to a respective commodity to be labeled.

Figure 3:
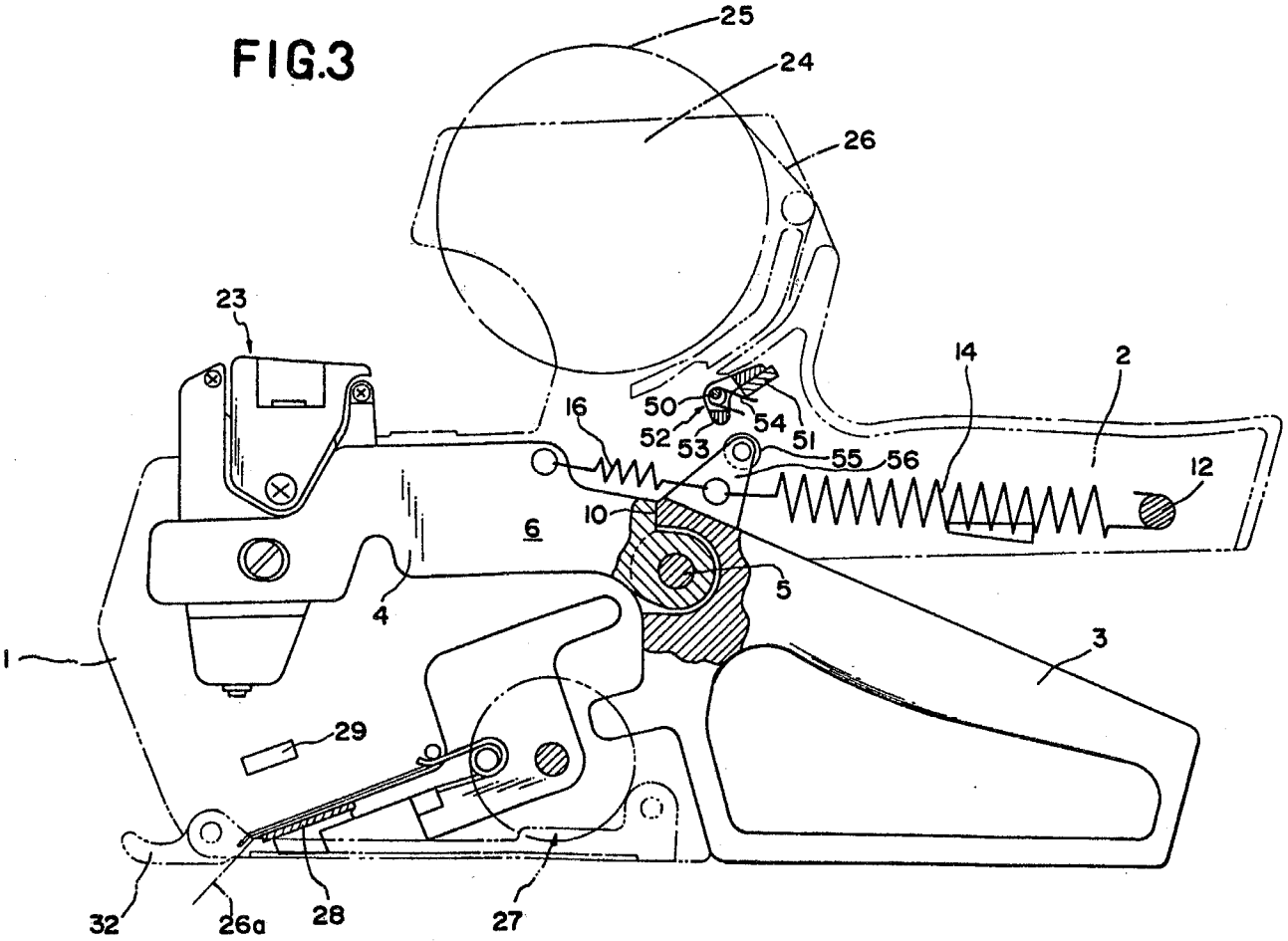
FIG. 3 is also a view similar to FIG. 1 showing a second embodiment of constant pressure printing mechanism according to the present invention.
Figure 4:
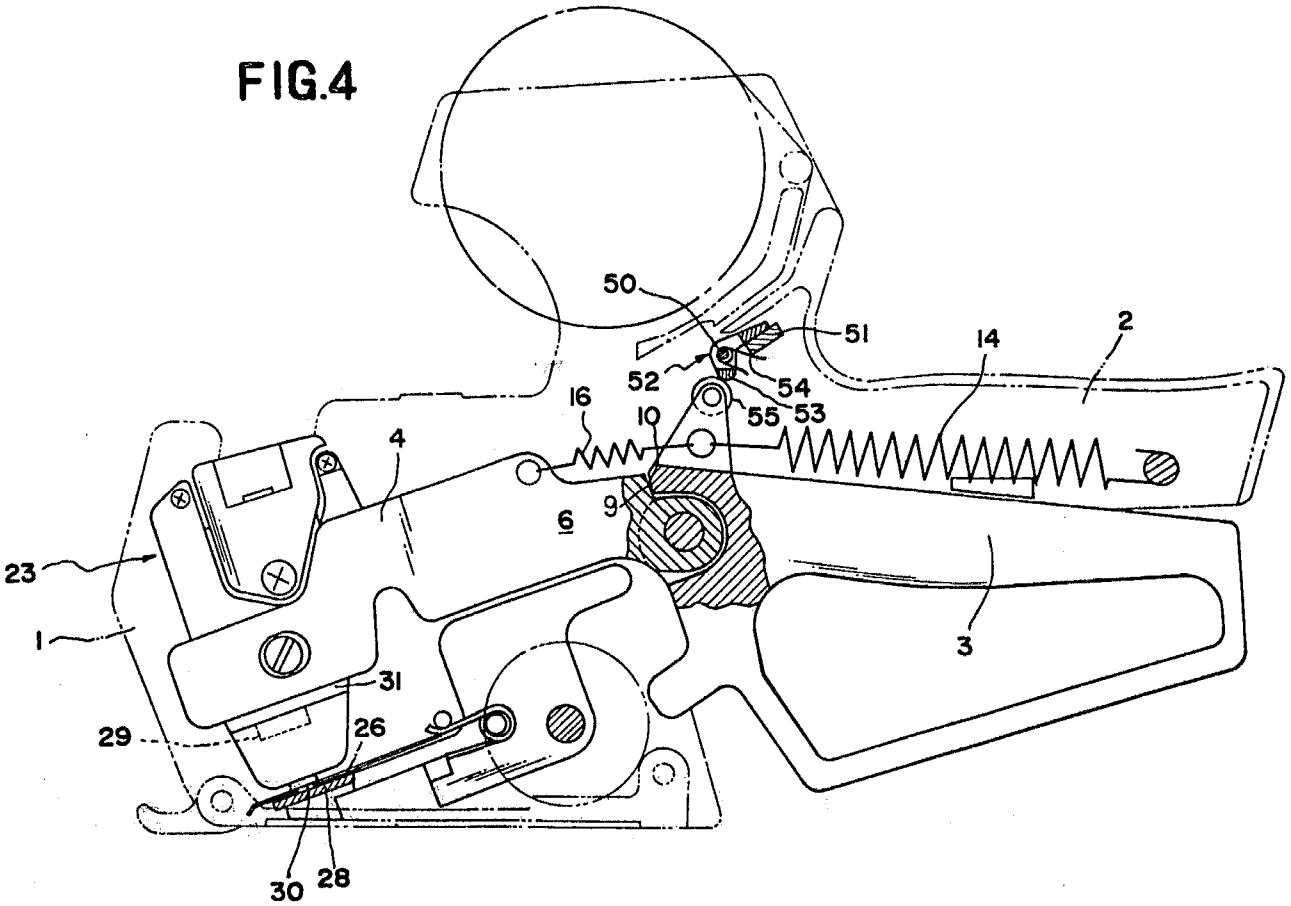
FIG. 4 shows the hand labeler of FIG. 3 in the printing condition with the hand lever squeezed.

The second embodiment of the invention, shown in FIGS. 3 and 4 is now described. This embodiment is similar to the first embodiment, except for the positions and configurations of the snap bail and the pressure roller. The remaining elements of the second embodiment are the same as in the first embodiment and are correspondingly numbered. Further descriptions of them are omitted.

In the second embodiment, a pivot pin 50 and a stopper 51 are fixedly mounted between the side frames 1 of the hand labeler above the pivot pin 5. There is pivotally mounted on the pivot pin 50 an L-shaped snap bail 52 which is made of an elastic material. The snap bail 52 is formed with a snap surface 53 at its lower end and is biased clockwise at all times by a torsion spring 54 which is wound around the pivot pin 50. The upper arm of the snap bail 52 abuts against the stopper 51 placed at the lower end surface of that upper arm so that the bail 52 is allowed to rotate only counterclockwise in FIG. 3.

A pressure roller 55 is mounted on the upper end of a roller holder 56, and the holder 56 projects from the upper end portion of the hand lever 3, whereby roller 55 pivots with lever 3.

The operation of the second embodiment is similar to that of the first embodiment. When the hand lever 3 is squeezed from the released condition and is turned counterclockwise together with the printing lever 4, the pressure roller 55 is brought into abutment engagement with the right-hand side of the snap surface 53 of the snap bail 52 and further rotation of roller 55 is resisted. When the hand lever 3 is further squeezed, the snap surface 53 of the elastic snap member 52 is pushed and deformed by the pressure roller 55 until the pressure roller 55 rides over and past the snap surface 53. Thereafter, the snap member 52 restores itself. Again, the printing lever 4 develops inertia as the actuating lever 3, 4 snaps past the snap member 52. The inertia of the printing lever 4 turns it counterclockwise about the pivot pin 5 and against the force of the return spring 16. Again the printing lever 4 and hand lever 3 separate. The inertia causes the printing types 30 of the printing head 23 to abut against the unrolled label strip 26 fed onto the printing platen 28 for the printing purpose, as seen in FIG. 4. Immediately following the imprinting, the printing lever 4 is turned upward by the force of the return spring 16 and the printing types 30 are separated from the label surface until the abutment surface 10 of the printing lever 4 again abuts against and stops at the abutment surface 9 of the hand lever 3.

When the hand lever 3 is released, during its subsequent return stroke, the pressure roller 55 engages the snap surface 53 of the snap bail 52 from the left hand side, and the snap bail 52 is turned counterclockwise, against the force of the spring 54, so that the hand lever 3 and the printing lever 4 are allowed to return to their initial conditions of FIG. 3, while the pressure roller 55 passes without significant resistance.

Figure 5:
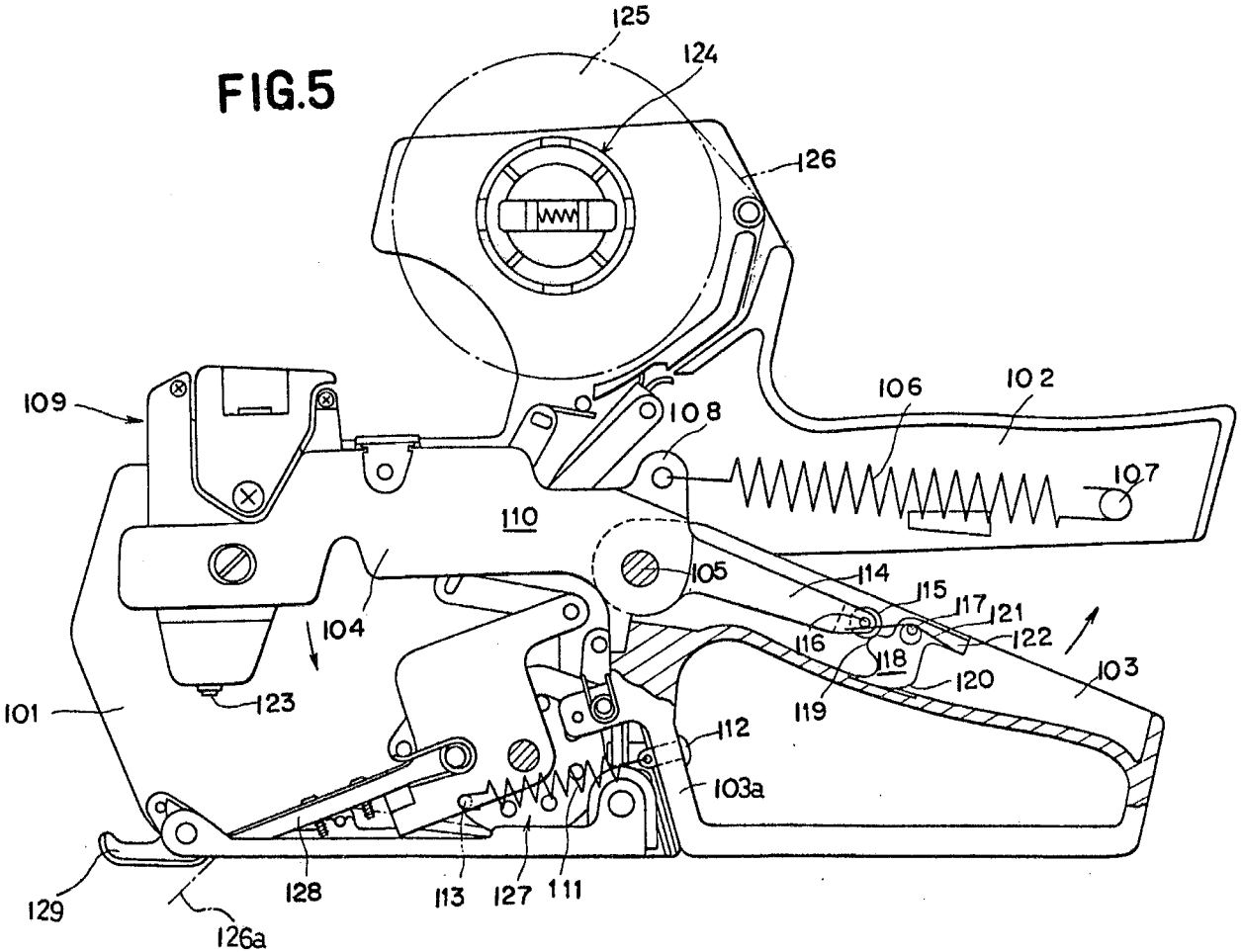
FIG. 5 is a side elevational view showing a hand labeler, which is equipped with a third embodiment of a constant pressure printing mechanism according to the present invention, with the side frame on the viewing side removed for illustration.

The third embodiment of a hand labeler, shown in FIG. 5, is also equipped with a constant pressure printing mechanism according to the present invention. All components of the labeler are place between the side frames 101. The side frames 101 are formed into an integral hand grip 102 at their rear or right hand ends. An actuating lever 110 is pivotally mounted between the side frames 101. The actuating lever 110 is divided into an operating or hand lever 103 and a separate printing lever 104. The printing lever 104 is in a bifurcated form for supporting the printing head 9. The rear end of the printing lever 104 is fitted into the space between the sides of the hand lever at the front end portion of the hand lever 103. A pivot pin 105 extends through the overlaid end portions of the levers 103 and 104 and extends further into the side frames 101. The hand lever 103 and the printing lever 104 are rotatable relative to each other around pin 105.

A first return spring 106 is mounted under tension between a spring pin 107, which is anchored at the inside of the grip 102, and a spring supporting projection 108 formed on the upper rear end of the printing lever 104. This biases the printing lever clockwise. Second return springs 111 are mounted under tension between the spring members 112 that are located at both sides of the frames 101 and are mounted to the front arm **103*a* of the hand lever 103 and fixed spring pins 113 anchored at the inner walls of the side frames 101. This biases the hand lever clockwise. As a result, both of the printing lever 104 and the hand lever 103** are biased clockwise at all times.

The rear or right hand end of the printing lever 104 carries an integral projection 114 which projects into the space between the sides of the hand lever 103. A pressure element, roller 115 is rotatably mounted to the rear end of the projection 114 by a pivot pin 116.

There is a snap member 118 which is comprised of an elastic material, such as a plastic. The member 118 is pivotally mounted on a pivot pin 117 which is anchored to both sides of the hand lever 103. At its front or left hand side, the snap member 118 projects forwardly to define a snap surface 119. The lower front portion of member 118 abuts against the inner bottom wall of the upper arm of the hand lever 103. The lower rear portion of the snap member is cut away to form a lower curved surface 120 around which member 118 may easily roll. A torsion spring 121 is wound on the pivot pin 117. The operating ends of spring 121 abut against the lower surface of the rear projection 122 of the snap member 118 and against the lower surface of the pivot pin 116 at the rear end of the operating projection 114. Thus, the snap member 118 is continuously biased counterclockwise about the pivot pin 117. The snap member 118 and the pressure roller 115 together are the snap means. Further, they are the cooperating abutting means that join the printing lever and the hand lever to move together as one actuating lever 106 toward the squeezed position of that lever.

A printing head 109 is mounted to the leading or front end of the bifurcated printing lever 104. The printing head 109 has a lower end that is equipped with printing types 123. There is a label holder 124 for a rolled label strip 125. A label strip 126 is unrolled from holder 124 and is fed onto a platen 128 by the action of a conventional feed mechanism 127.

The operation of the third embodiment of a constant pressure printing mechanism according to the present invention is now explained.

FIG. 5 shows the hand labeler in its stationary or released condition. The printing lever 104 is in an inoperative position apart from the printing platen 128. The snap member 118, mounted to the hand lever 103, has its forwardly projecting snap surface 119 positioned below and abutting against the underside of the pressure roller 115 at the rear end of the operating projection 114. This placement of roller 115 and surface 119, coupled with the continuous bias of spring 106, holds the printing lever 104 securely to the hand lever 103 so that they pivot together around pivot 105 as a single unit.

The grip 102 and the hand lever 103 are squeezed and this turns the lever 103 upwardly or counterclockwise. The snap surface 119 of the snap member 118 pushes up the pressure roller 115, so that the printing lever 104 is turned counterclockwise about the pivot pin 105 together with the printing head 109. At the same time, an ink roller (not shown) rolls on the types 123 at the lower end of the printing head 109 so as to supply them with ink.

Figure 6:
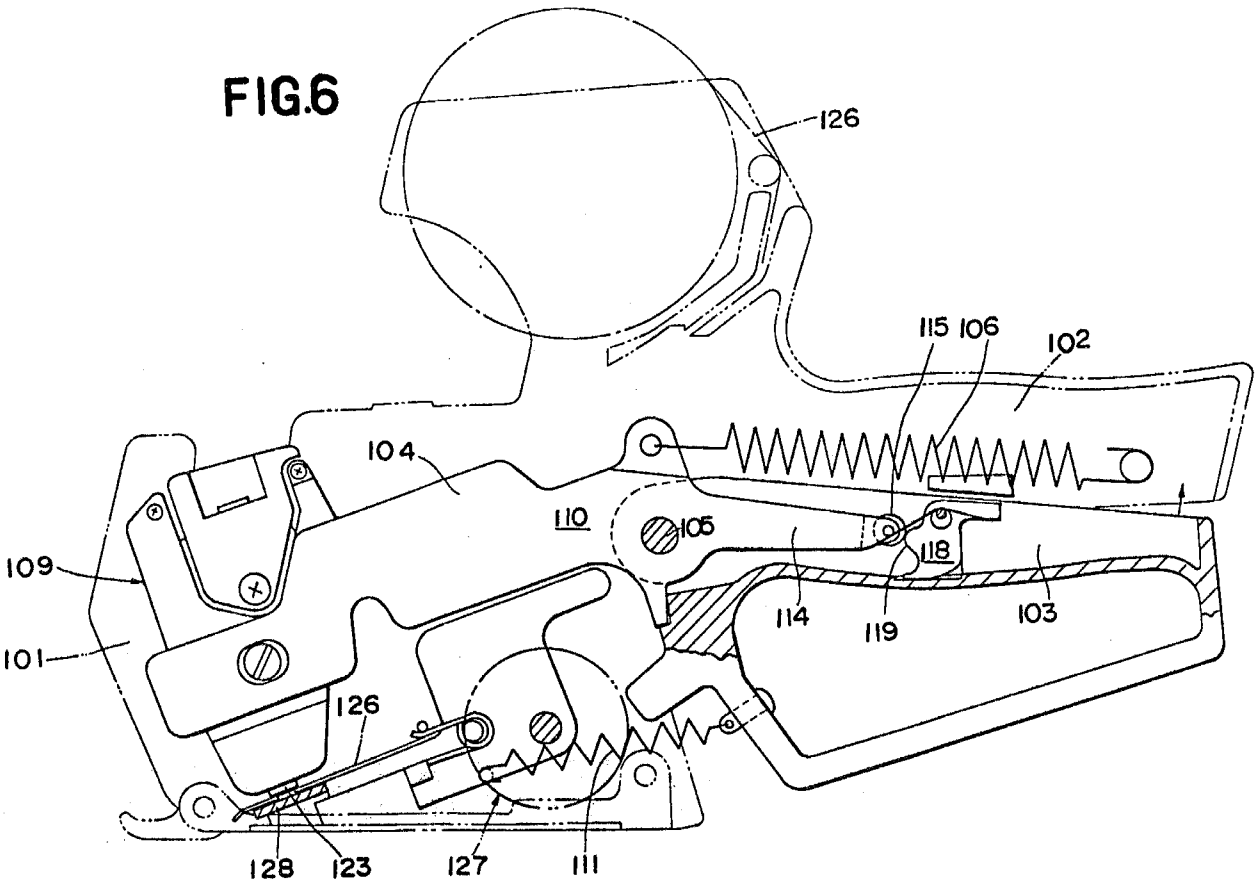
FIG. 6 shows the hand labeler of FIG. 5 in the printing condition, with the hand lever partially squeezed.
Figure 7:
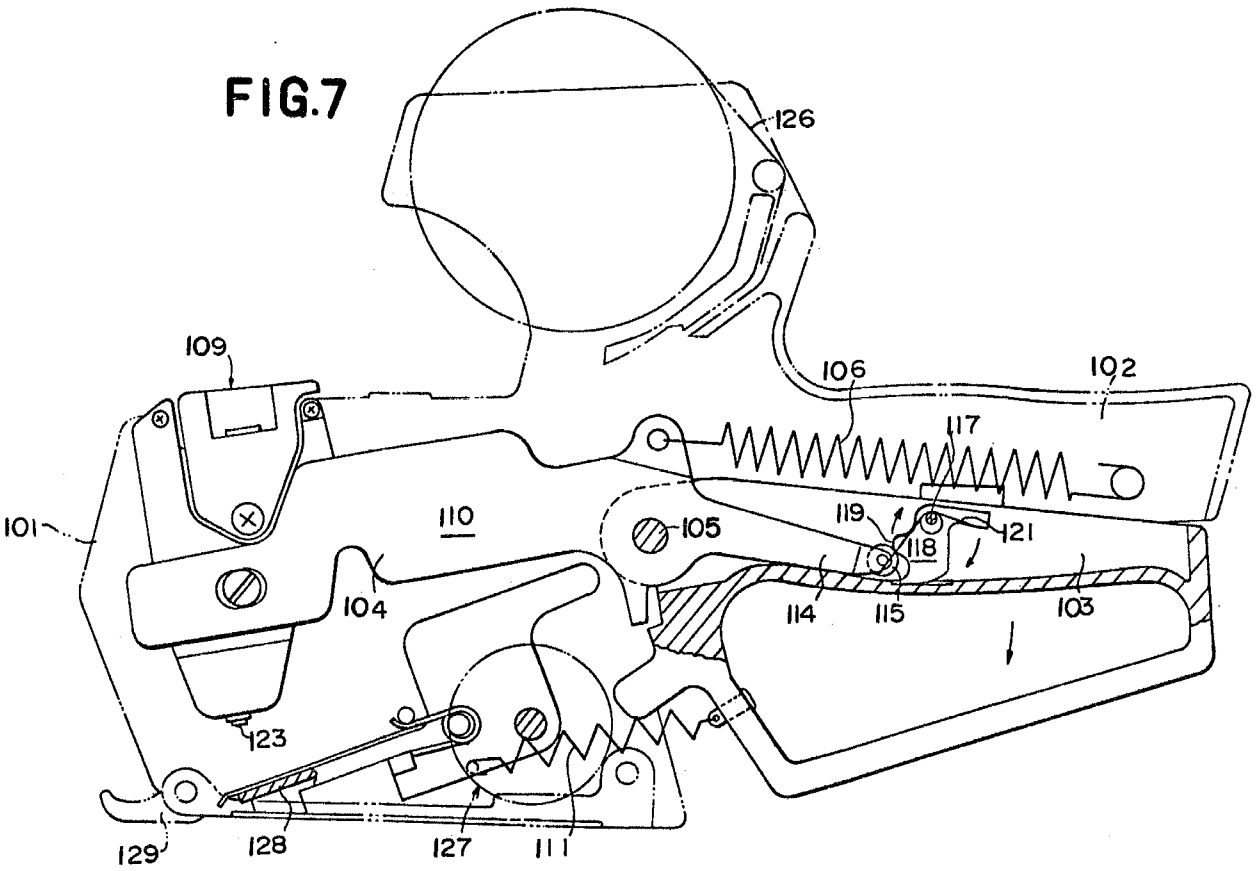
FIG. 7 shows the hand labeler of FIG. 5 as it is starting to return from the condition of the hand lever being squeezed to its full stroke.

When the hand lever 103 is squeezed far enough, the types 123 at the lower end of the printing head 109 are moved into abutment with the unrolled label strip 126 on the platen 128 so as to accomplish the printing, as seen in FIG. 6. Unlike the first two embodiments, the initial contact between the printing head and the platen occurs before the snap member 118 snaps past the roller 115. After the types abut the platen, as the hand lever 103 is rotated further upward by further squeezing of the hand lever 103, the snap surface 119 of the snap member 118 is depressed strongly by the pressure roller 115 since further rotation of the printing lever 104 is being resisted by the platen. At this time, the pressure roller 15 is being held stationary together with the printing lever 104. The roller 115 thus resists the squeezing force on the hand lever 103. The elastic material of the snap surface 119 is compressed until the snap surface rides over or snaps over the pressure roller 115 to an upper position. Prior to the snap over, the squeezing pressure on the hand lever 103 becomes printing pressure by the types. Thus, the constant pressure at which the roller 115 and snap surface 119 pass each other determines the constant printing pressure.

Simultaneously with the snap over which releases the printing lever to pivot clockwise with respect to the hand lever, the printing lever 104 is turned clockwise by the biasing force of the return spring 106 so that the printing head 109 is lifted to separate the printing types 123 from the imprinted label surface, as seen in FIG. 3. The clockwise turning of the printing lever 104 stops when the lower surface of the operating projection 114 abuts against the inner bottom of the upper arm of the hand lever 103.

When the hand lever 103 is released, the printing lever 104 and the hand lever 103 are turned clockwise about the pivot pin 5 by the tensile actions of the return spring 106 acting on the printing lever 104 and the return spring 111 acting on the hand lever 103 until the levers 103 and 104 are restored to their initial conditions of FIG. 5. Since, in this return motion, the hand lever 103 has a larger angle of rotation than the printing lever 104, the snap surface 119 of the snap member 118 is pushed upward from beneath its lower surface by the pressure roller 115. The return procedure is quite different from the squeezing procedure. The snap member 118 receives a clockwise force from the pressure roller 115. Since the snap member 118 has its lower rear surface 120 curved, the snap surface 119 can ride over the pressure roller 115 while being turned clockwise about the pivot pin 117 with the aid of the biasing action of the spring 121. Thus, the hand lever 103 can be restored to its initial condition merely through the action of the return spring 111, without such return motion being subjected to large resistance.

Meanwhile, the unrolled label strip 126 is advanced by the length of one label, through the action of the conventional feed mechansim 127, so that the printed labels 126*a* are fed, one by one, to the platen and after being printed to a position below a label applying member 129.

As has been described hereinbefore, according to the present invention, the actuating lever is divided into two separate portions, i.e., the operating or hand lever and the printing lever. In the first two embodiments, only the printing leverl 4 is turned through the final label printing stroke by its own inertia. The printing stroke occurs when the snap bail and the pressure roller pass each other, and the printing types are instantly moved into abutment against the label surface. In the third embodiment, on the other hand, the pressure member and the snap member ride one over the other only after the initial contact between the printing head and the labels and while imprinting is occurring. The snap over here determines the maximum printing pressure resulting from the squeezing of the hand lever, and the snap over also frees the printing lever and the printing head to move apart from the label surface.

The following results can be obtained:

(1) In all embodiments, since the printing is not effected or completed until the pressure member and the snap member pass each other, different squeezing pressures applied to the hand lever can be substantially equalized in terms of the pressure applied by the printing head to the labels.

(2) In the first two embodiments, since the printing lever is moved toward the printing head while overcoming the resistance from the elastic member, the printing pressure of the printing types upon the label surface can be made constant so that clear imprints, with little shading differences, can be obtained at all times on all labels.

(3) In the first two embodiments, since the printing of labels is caused by the constant inertial motion of the printing lever past the snap point, in opposition to a return spring, the duration of each printing stroke against a label is constant.

(4) In the third embodiment, since the printing types are urged to leave the label surface immediately after the printing operation and immediately after a predetermined squeezing force on the hand lever is exceeded, squeezing force applied to the hand lever after the snap over is not converted directly into printing pressure, thereby ensuring a substantially constant printing pressure.

(5) In the third embodiment, since the hand lever cannot be squeezed to its full stroke without subsequent return rotation of the printing lever to separate the printing types from the label surface, the time period during which the printing types are in contact with the label surface is substantially constant irrespective of the duration of a squeeze.

(6) In all embodiments, since the duration of the abutment contact of the printing types with the label surface is substantially constant irrespective of the duration of a squeeze, the quality and consistency of the imprints obtainable can be assured.

(7) In the first two embodiments, since the printing operation is carried out against the action of the elastic member interposed between the hand lever and the printing lever, and since the printing lever is instantly returned after each printing operation, the squeezing force on the hand lever is not converted directly into printing pressure, even when the hand lever is squeezed strongly. Accordingly, there is no rebound of the printing head at the surface of the platen, thus helping to prevent double printing.

(8) In the third embodiment, even when the hand lever is squeezed especially strongly and swiftly, the squeezing force can be damped and absorbed by the rideover operation and rebound of the printing head at the surface of the platen can be avoided, thus helping to prevent double printing.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A constant pressure printing mechanism for use with an apparatus for imprinting a label, or the like, comprising:

a printing platen for supporting a label, or the like, to be imprinted;

an actuating lever movable between a released position and a squeezed position; said actuating lever being divided into an operating lever and a separate printing lever; said operating and said printing levers being pivotally connected together;

a printing head connected to said printing lever and movable thereby between an inoperative position, wherein said printing head is apart from said platen, when said actuating lever is at said released position, and a printing position of said printing head against said platen, when said actuating lever is at said squeezed position thereof;

biasing means for biasing said operating and said printing levers to pivot with respect to each other and for normally biasing said printing head toward said inoperative position;

cooperating abutting means on said printing lever and on said operating lever for being engaged under the influence of said biasing means and thereby for holding said printing lever and said operating lever so that they move together, to said actuating lever squeezed position, in opposition to the bias of said biasing means;

snap means for engaging said actuating lever for resisting motion of said printing lever toward said printing head printing position, which such motion of said printing lever is caused by motion of said actuating lever to said squeezed position thereof; said snap means being constructed such that when said actuating lever is fully moved to said squeezed position thereof, said snap means is overridden in a snap manner; said snap means being adapted to exert a predetermined resistance to being overridden; said predetermined resistance of said snap means, when overcome, defining a predetermined pressure upon said printing lever to drive said printing lever to move said printing head to said printing head printing position at a predetermined pressure of said printing head; upon said snap means being overridden, said cooperating abutting means are caused to free said printing and said operating levers to move separately and said printing lever is thereby freed to return toward said printing head inoperative position under the bias of said biasing means.

2. The constant pressure printing mechanism of claim 1, further comprising return spring means connected with said operating lever for returning it to said actuating lever released position; said biasing means being connected to said printing lever for normally biasing said printing lever to move said printing head to said inoperative position thereof.

3. The constant pressure printing mechanism of claim 2, wherein said snap means is elastic so as to elastically resist motion of said printing lever and to elastically deform so as to permit said snap means to be overridden.

4. The constant pressure printing mechanism of claim 1, wherein said snap means is biased to the position at which it resists motion of said printing lever.

5. The constant pressure printing mechanism of claim 3, wherein said snap means is placed for being engaged by said actuating lever prior to said printing head being moved to said printing position; said snap means being placed such that said actuating lever snaps past said snap means before said actuating lever is fully squeezed to said squeezed position thereof; said snap means being positioned and adapted to block that motion of said actuating lever which causes said printing lever to move said printing head to said printing position thereof;

said cooperating abutting means assure that when said actuating lever snaps past said snap means, the snap motion of said operating lever is abuttingly transmitted to and imparts motion to said printing lever in the direction to move said printing head to said printing position thereof, and the inertia of said printing lever moving in that direction moves said printing lever, with respect to said operating lever, to move said printing head to said printing position against the bias of said biasing means.

6. The constant pressure printing mechanism of claim 5, further comprising an operating lever stopper on said frame and positioned to be engaged by said operating lever after said actuating lever snaps past said snap means for preventing further motion of said actuating lever beyond said squeezed position thereof; said printing lever not engaging said operating lever stopper, whereby said printing lever is freed to move, under the influence of its inertia, with respect to said operating lever.

7. The constant pressure printing mechanism of either of claims 1 or 2, wherein said snap means comprises said cooperating abutting means and said snap means engages said printing lever and said operating lever and holds same together for causing them to move together as a unit and also for preventing relative motion of said printing lever and said operating lever, under the influence of said biasing means; the joined said printing lever and said operating lever moving said printing head to said printing position thereof as said actuating lever is moved to said squeezed position thereof;

upon said printing head reaching said printing position thereof, said snap means resisting further motion of said operating lever, with respect to said printing lever, to a fully squeezed position of said operating lever; as squeezing upon said operating lever is increased to override the resistance of said snap means, said printing head applying a correspondingly increasing pressure to said platen; upon said operating lever applying more than a predetermined pressure to said snap means, said snap means being operated to disconnect said operating lever and said printing lever, thereby freeing said printing lever to move, under the influence of said biasing means, away from said platen and with respect to said operating lever.

8. The constant pressure printing mechanism of claim 7, further comprising return spring means normally biasing said actuating lever to said released position thereof, whereby said actuating lever is moved to said squeezed position against the urging of said return spring means.

9. The constant pressure printing mechanism of claim 8, wherein said snap means comprises a pressure element on one of said operating lever and said printing lever and comprises a deflectable snap element on the other of said printing lever and said operating lever; said snap element being biased to hold said pressure element from snapping past said snap element until said pressure element applies a predetermined pressure to said snap element.

10. A constant pressure printing mechanism for use with an apparatus for imprinting a label, or the like, comprising:

a printing platen for supporting a label, or the like, to be imprinted;

an actuating lever movable between a released position and a squeezed position; said actutating lever being divided into an operating lever and a separate printing lever; said operating and said printing levers being pivotally connected together;

a printing head connected to said printing lever and movable thereby between an inoperative position, wherein said printing head is apart from said platen, when said actuating lever is at said released position, and a printing position of said printing head against said platen, when said actuating lever is at said squeezed position thereof;

biasing means for biasing said operating and said printing levers to pivot with respect to each other and for normally biasing said printing head toward said inoperative position;

cooperating abutting means on said printing lever and on said operating lever being engaged under the influence of said biasing means and thereby for holding said printing lever and said operating lever so that they move together, to said actuating lever squeezed position, in opposition to the bias of said biasing means;

snap means for engaging said actuating lever for resisting motion of said printing lever toward said printing head printing position, which such motion of said printing lever is caused by motion of said actuating lever to said squeezed position thereof; said snap means being placed for being engaged by said actuating lever before said printing head is moved to said printing position; said snap means being positioned and adapted to block that motion of said actuating lever which causes said printing lever to move said printing head to said printing position thereof; said snap means being constructed such that when said actuating lever is being fully moved to said squeezed position thereof, said snap means is overridden in a snap manner; said snap means being adapted to exert a predetermined resistance to being overridden; said snap means being placed such that said actuating lever snaps past said snap means before said actuating lever is fully squeezed to said squeezed position thereof;

said cooperating abutting means assure that when said actuating lever snaps past said snap means, the snap motion of said operating lever is abuttingly transmitted to and imparts motion to said printing lever in the direction to move said printing head to said printing position thereof, and the inertia of said printing lever moving in that direction moves said printing lever, with respect to said operating lever, to move said printing head to said printing position against the bias of said biasing means.

11. The constant pressure printing mechanism of claim 10, wherein said snap means is placed such that it is said operating lever of said actuating lever that engages said snap means.

12. The constant pressure printing mechanism of either of claims 10 or 11, further comprising an operating lever stopper positioned to be engaged by said operating lever after said actuating lever snaps past said snap means for preventing further motion of said actuating lever beyond said squeezed position thereof, and said printing lever not engaging said operating lever stopper, whereby said printing lever is freed to move under the influence of its inertia with respect to said operating lever.

13. The constant pressure printing mechanism of claim 12, wherein said cooperating abutting means are placed and shaped to abut as said actuating lever is being moved to said squeezed position and to become disengaged after said operating lever engages said operating lever stopper and said printing lever continues to move under its own intertia.

14. The constant pressure printing mechanism of claim 12, further comprising a support frame; said platen being supported by said frame; said actuating lever being supported by said frame for movement, with respect to said frame, between said squeezed and said released positions thereof.

15. The constant pressure printing mechanism of claim 14, further comprising a printing head stopper on said frame and positioned to be engaged by said printing head when said printing head is in said printing position thereof for blocking further motion of said printing head toward said platen.

16. The constant pressure printing mechanism of claim 15, further comprising an operating lever stopper on said frame and positioned to be engaged by said operating lever after said actuating lever snaps past said snap means for preventing further motion of said actuating lever beyond said squeezed position thereof, and said printing lever not engaging said operating lever stopper, whereby said printing lever is freed to move, under the influence of its inertia, with respect to said operating lever.

17. The constant pressure printing mechanism of claim 14, further comprising an operating lever stopper on said frame and positioned to be engaged by said operating lever after said actuating lever snaps past said snap means for preventing further motion of said actuating lever beyond said squeezed position thereof, and said printing lever not engaging said operating lever stopper, whereby said printing lever is freed to move, under the influence of its inertia, with respect to said operating lever.

18. The constant pressure printing mechanism of claim 14, wherein said snap means comprises a pressure element mounted to one of said operating lever and said frame and further comprises a snap bail mounted to the other of said operating lever and said frame; said snap bail being normally biased to resist relative bypassage of said pressure element and said snap bail, whereby a predetermined resistance is established to bypassage of said pressure element and said snap bail, and upon bypassage of these elements, a predetermined force is produced by the snap motion and is imparted to said actuating lever, and through said cooperating abutting means, the force imparted to said actuating lever imparts a predetermined initial force to said printing lever.

19. The constant pressure printing mechanism of claim 18, further comprising return spring means normally biasing said actuating lever to said released position thereof.

20. The constant pressure printing mechanism of claim 18, wherein said actuating lever is pivotally supported to said frame for pivoting with respect thereto between its said positions.

21. The constant pressure printing mechanism of claim 18, wherein said pressure element comprises a pressure roller that is rotatably mounted in position to the respective one of said frame and said operating lever which carries said pressure element.

22. The constant pressure printing mechanism of claim 21, wherein said snap bail comprises an arm which is movably mounted to the respective one of said frame and said operating lever and further comprises respective biasing means for biasing said bail to a position for blocking bypassage of said pressure element.

23. The constant pressure printing mechanism of claim 22, wherein said bail arm is pivotally mounted to pivot between its various positions.

24. The constant pressure printing mechanism of claim 18, wherein said snap bail is on said operating lever and said pressure element is on said frame, and said snap bail is moved past said pressure element.

25. The constant pressure printing mechanism of claim 24, wherein said pressure element comprises a pressure roller rotatably mounted in position on said frame.

26. The constant pressure printing mechanism of either of claims 24 or 25, wherein said snap bail comprises an arm which is movably mounted to said operating lever and further comprises respective biasing means for biasing said bail to a position for blocking bypassage of said pressure element.

27. The constant pressure printing mechanism of claim 18, wherein said snap bail is on said frame and said pressure element is on said operating lever and said pressure element is moved past said snap bail.

28. The constant pressure printing mechanism of claim 27, wherein said pressure element comprises a pressure roller rotatably mounted in position to said operating lever.

29. The constant pressure printing mechanism of either of claims 27 or 28, wherein said snap bail comprises an arm which is movably mounted to said frame and further comprises respective biasing means for biasing said bail to a position for blocking bypassage of said pressure element.

30. A constant pressure printing mechanism for use with an apparatus for imprinting a label, or the like, comprising:

a printing platen for supporting a label, or the like, to be imprinted;

an actuating lever movable between a released position and a squeezed position; said actuating lever being divided into an operating lever and a separate printing lever; said operating and said printing levers being pivotally connected together;

a printing head connected to said printing lever and movable thereby between an inoperative position, wherein said printing head is apart from said platen, when said actuating lever is at said released position, and a printing position of said printing head against said platen, when said operating lever is at said squeezed position thereof;

biasing means for biasing said operating and said printing levers to pivot with respect to each other and for normally biasing said printing head toward said inoperative position;

snap means on said printing lever and on said operating lever for joining those said levers for movement to said actuating lever squeezed position, in opposition to the bias of said biasing means; upon motion of said actuating lever toward said squeezed position thereof and before said actuating lever has been fully squeezed, said printing head abutting said platen at said printing position thereof;

upon said printing head reaching said printing position thereof, said snap means resisting further motion of said operating lever, with respect to said printing lever, to a fully squeezed position of said operating lever; as squeezing upon said operating lever is increased to override the resistance of said snap means, said printing head applying a correspondingly increasing pressure to said platen; upon said operating lever applying more than a predetermined pressure to said snap means, said snap means being operated to disconnect said operating lever and said printing lever so that they are no longer joined for movement together and said printing lever being thereafter freed to move, under the influence of said biasing means, away from said platen and with respect to said operating lever.

31. The constant pressure printing mechanism of claim 30, further comprising a support frame; said platen being supported by said support frame; said actuating lever being supported by said frame for movement, with respect to said frame, between said inoperative and said printing positions thereof.

32. The constant pressure printing mechanism of either of claims 30 or 31, further comprising return spring means normally biasing said actuating lever to said released position thereof, whereby said actuating lever is moved to said squeezed position against the urging of said return spring means.

33. The constant pressure printing mechanism of claim 31, wherein said actuating lever is pivotally supported to said frame for pivoting with respect thereto between its said positions.

34. The constant pressure printing mechanism of claim 31, wherein said snap means comprises a pressure element on one of said operating lever and said printing lever and comprises a deflectable snap element on the other of said printing lever and said operating lever; said snap element being biased to hold said pressure element from snapping past said snap element until said pressure element applies a predetermined pressure to said snap element.

35. The constant pressure printing mechanism of claim 31, wherein said snap means comprises a pressure element on said printing lever and comprises a deflectable snap element on said operating lever; said snap element being biased to hold said pressure element from snapping past said snap element until said pressure element applies a predetermined pressure to said snap element.

36. The constant pressure printing mechanism of either of claims 34 or 35, wherein said pressure element and said snap element each engage one another on respective sides thereof selected for causing the pressure on said operating lever that moves said actuating lever to said squeezed position thereof to correspondingly move said printing lever to move said printing head to said printing position thereof, and snapping of said pressure element past said snap element moves said pressure element free of the aforesaid engagement of said pressure element and said snap element, thereby freeing said printing lever to move away from said platen.

37. The constant pressure printing mechanism of claim 36, wherein said snap element is pivotally mounted, and snap element biasing means normally bias said snap element into position to obstruct bypassage of said pressure element.

38. The constant pressure printing mechanism of claim 36, wherein said snap element is movably mounted, and snap element biasing means normally bias said snap element into position to obstruct bypassage of said pressure receiving element.

39. The constant pressure printing mechanism of claim 36, further comprising an operating lever stopper on said frame which is positioned to be engaged by said operating lever after said operating lever has been moved to said squeezed position thereof and after said operating lever has been moved sufficiently that said pressure receiving element and said snap element have snapped past one another.

40. The constant pressure printing mechanism of claim 35, further comprising return spring means normally biasing said actuating lever to said released position thereof, whereby said actuating lever is moved to said squeezed position against the urging of said return spring means; said return spring means being connected to said operating lever.

* * * * *